US005355592A

United States Patent [19]

Pardini

[11] Patent Number: 5,355,592

[45] Date of Patent: Oct. 18, 1994

[54] PASTA MAKING ACCESSORY

[76] Inventor: Ronald J. Pardini, 3033 E. Thunderbird, #2081, Phoenix, Ariz. 85032

[21] Appl. No.: 97,152

[22] Filed: Jul. 26, 1993

[51] Int. Cl.[5] ..... F26B 25/00

[52] U.S. Cl. ..... 34/104; 34/440; 34/239; 211/171

[58] Field of Search ..... 34/90, 91, 239, 104, 34/240, 437, 439, 440; 211/171, 195–197

[56] References Cited

U.S. PATENT DOCUMENTS

| | | | |
|---|---|---|---|
| D. 267,768 | 2/1983 | Duggan | D7/76 |
| 773,787 | 11/1904 | Crossman | 211/171 |
| 1,326,808 | 12/1919 | Trager | 211/171 |
| 1,563,137 | 11/1925 | Amsler | 34/239 |
| 2,469,298 | 5/1949 | Gilmore, Jr. | 211/171 |
| 5,247,752 | 9/1993 | Gyr et al. | 34/104 |

*Primary Examiner*—Denise L. Gromada

*Attorney, Agent, or Firm*—John R. Flanagan

[57] ABSTRACT

A pasta making accessory includes a base for placement upon a table or counter top, an elongated hollow tubular post supported at a bottom end on the base and extending upright therefrom to a top open end, the tubular post an interior storage cavity extending between the bottom and top ends, and elongated pasta drying sticks adapted to be removably placed and stored during non-use in a closely packed relationship with one another in the elongated interior cavity of the tubular post. The tubular post has a plurality of pairs of holes defined about an upper portion of the tubular post for removably mounting therethrough at inner ends the plurality of pasta drying sticks. The drying sticks extend outwardly from and about the tubular post in a radial and helical path so as to provide sufficient space between the drying sticks to facilitate draping of freshly extruded pasta strips thereover for proper drying thereof.

19 Claims, 2 Drawing Sheets

PASTA MAKING ACCESSORY

BACKGROUND OF THE INVENTION

1. Field of the Invention

The present invention generally relates to kitchen and cooking accessories and, more particularly, is concerned with a pasta making accessory functioning dually as a paper towel holder/dispenser.

2. Description of the Prior Art

A variety of structures have been developed over the years principally for the purpose of air drying clothes and other similar items indoors. Such structures were especially significant in the years prior to the advent of automatic clothes dryers.

Diverse purposes, however, may be fulfilled by these types of structures. In recent years fairly compact structures have been developed to meet food preparation requirements such as for drying freshly made pasta.

Representative examples of these types of structures are disclosed in U.S. Pat. Nos. to Crossman et al (773,787), Trager (1,326,808), Gilmore, Jr. (2,469,298) and Duggan (Des. No. 267,768). The Crossman et al, Trager and Gilmore, Jr. structures each address the requirements for a clothes drying structure. Each basically provides an upright structure with collapsible arms radially extendable from a stabilizing central vertical member. The Duggan structure serves dual functions as a pasta drying rack and as a trivet for placement under warm casserole dishes and the like. This structure provides a pair of opposed collapsible racks extending from a straight member.

While potentially adaptable for purposes other than clothes drying, the Crossman et al, Trager and Gilmore, Jr. structures are all rather complicated in design and construction and thus costly in manufacture. The Duggan structure provides a simple design, but the specific drying rack features non-removable, closely spaced drying sticks. This dense structural arrangement tends to restrict the adequate flow of air through the pasta strips, thus inhibiting their proper drying.

Consequently, a need exists for a pasta making accessory which is simple in design and construction, using readily available materials, for inexpensive manufacture and ease in use by the average person. The accessory should provide flexible drying features such that freshly prepared food items such as pasta can be dried sufficiently and efficiently to meet mealtime schedules. The accessory should be easy to clean so that it can be used frequently. The accessory should also provide compact storage features for the specific drying elements so as to fit neatly into kitchen counter arrangements. An available dual feature of the accessory such as a holder/dispenser for paper towels would be an added benefit for a kitchen cooking area.

SUMMARY OF THE INVENTION

The present invention provides a pasta making accessory designed to satisfy the aforementioned need by avoiding the drawbacks of the prior art without introducing other drawbacks. Instead, the pasta making accessory of the present invention provides expanded capabilities not available in the prior art devices.

One capability is the simplicity in design and construction of the pasta making accessory using readily available materials for inexpensive manufacture and ease in use by the average person. A second capability is the utilization of the drying sticks as measurement instruments for cutting pasta strips into optimum lengths for drying. A third capability is the radial configuration of the drying sticks when removably mounted on the post for proper and efficient drying of the pasta strips draped thereover. A fourth capability is the easy cleanability of the accessory for frequent use and the compact storability of the accessory on a table or kitchen counter. A fifth capability is the dual function of the accessory as a paper towel holder dispenser.

Accordingly, the present invention is directed to a pasta making accessory which comprises: (a) a base for placement upon a support surface; (b) an elongated hollow tubular post supported at a bottom end on the base and extending upright therefrom, the tubular post having an open top end and an interior storage cavity extending between the bottom and top ends; and (c) a plurality of elongated pasta drying sticks adapted to be removably placed and stored during non-use in a closely packed relationship with one another in the elongated interior cavity of the tubular post. The tubular post has means defined thereon for removably mounting the plurality of pasta drying sticks in an outward radially extending relationship about the tubular post so as to permit draping of pasta strips thereover for drying.

The tubular post has an elongated continuous sidewall extending between the opposite top and bottom open ends. The sidewall defines the interior storage cavity extending between the opposite top and bottom ends. The storage cavity is of sufficient diameter and height to store the pasta drying sticks therein. The tubular post is received at its bottom open end into the central recess of the base so as to be attached thereto and supported thereon and extend upright therefrom. A top end cap is removably fittable on the top open end of the tubular post.

The means for removably mounting the pasta drying sticks to the tubular post is a plurality of pairs of holes defined about an upper portion of the tubular post. The holes in a given pair are defined at the same height above the base but on opposite sides of the tubular post diametrically across the interior storage cavity of the tubular post from one another. Each hole extends through the sidewall of the tubular post between the outer and inner surfaces thereof. Also, each pair of holes is located at a height above the base different from the height of each other pair of holes. Also, each pair of holes is located at an angular position about the tubular post different from the position of each other pair of holes. Thus, pairs of holes are arranged in a radial and helical pattern about the upper portion of the tubular post.

Each pasta drying stick is in the form of an elongated straight shaft extending between a pair of opposite ends. Each of the plurality of drying sticks is mounted through one pair of the plurality of pairs of holes in the tubular post. More particularly, each drying stick is mountable at one end through one of the pair of holes defined in the tubular post such that the one end extends through the first hole of the pair and extends through and protrudes slightly beyond the second hole of the pair. With the pairs of holes being so arranged and the plurality of drying sticks being so mounted in the pairs of holes, the drying sticks thereby extend radially outwardly from the tubular post and encircle the post in a helical path so as to provide sufficient space between the sticks to facilitate draping of freshly extruded pasta strips thereover for proper drying thereof.

The pasta making accessory also serves a dual function as a paper towel holder dispenser. The tubular post is adapted to removably receive a roll of paper towels thereover standing on the base when the pasta drying sticks are removed from about the tubular post.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
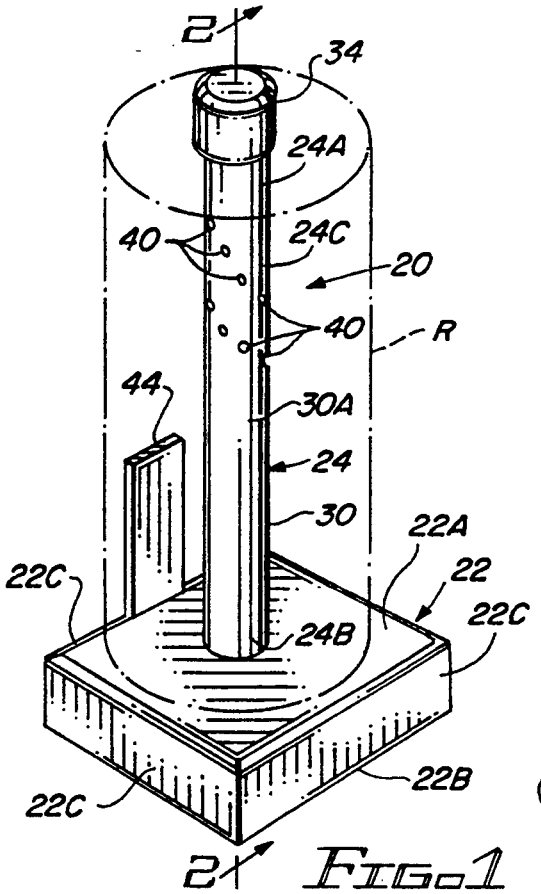
FIG. 1 is a perspective view of a pasta making accessory of the present invention in a storage condition in which the accessory can function as a paper towel holder dispenser.
Figure 2:
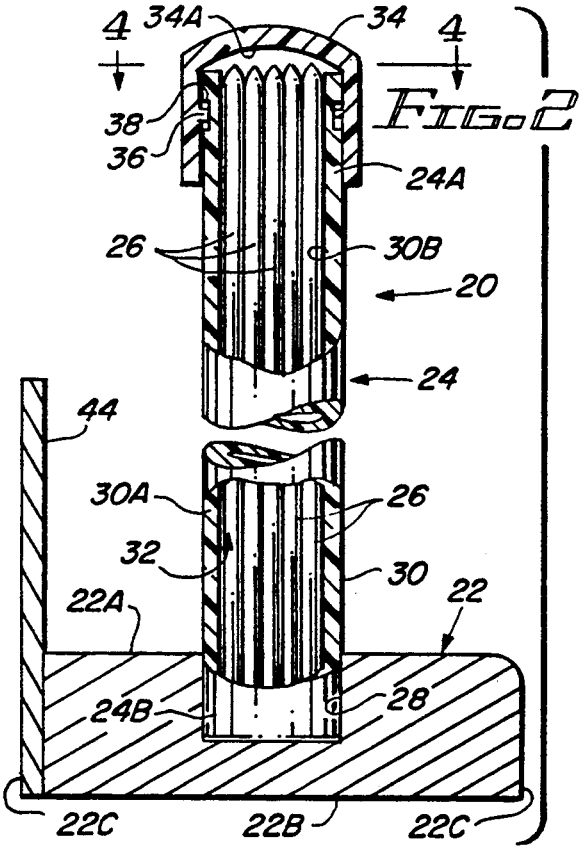
FIG. 2 is an enlarged foreshortened vertical sectional view of the accessory taken along line 2—2 of FIG. 1, showing storage of a plurality of pasta drying sticks within an elongated upright hollow tubular post of the accessory.
Figure 5:
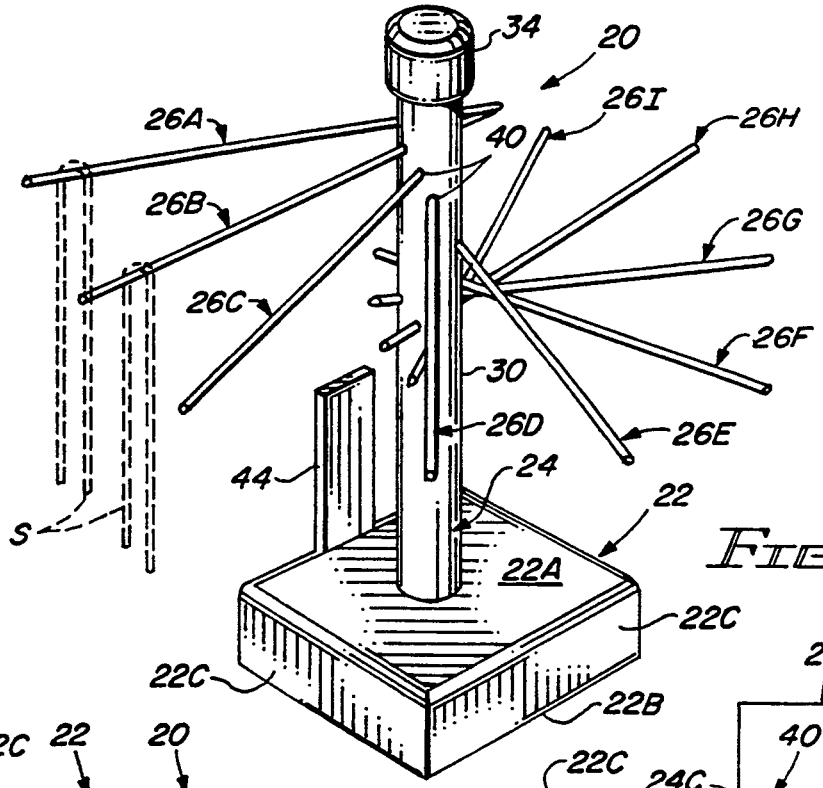
FIG. 5 is a perspective view of the pasta making accessory of the present invention in a deployed condition in which the plurality of pasta drying sticks are mounted about the tubular post of the accessory.
Figure 4:
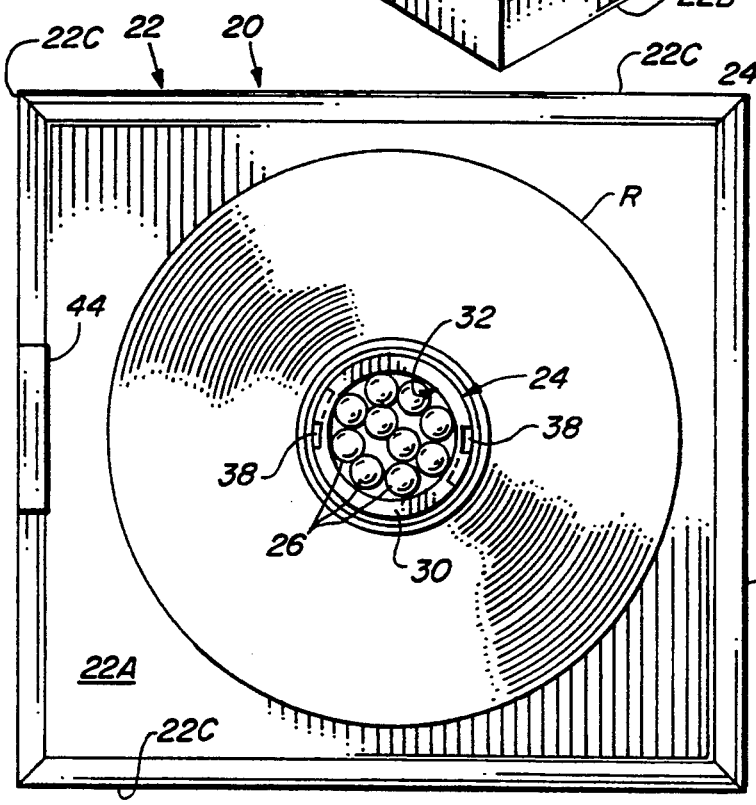
FIG. 4 is a top plan view of the accessory as seen along line 4—4 of FIG. 2 with the top end cap removed, also showing a roll of paper towels surrounding the tubular post.

Referring to the drawings and particularly to FIGS. 1, 2 and 4–6, there is illustrated a pasta making accessory, generally designated 20, of the present invention. Basically, the pasta making accessory 20 includes a base 22, an elongated hollow tubular post 24, and a plurality of elongated pasta drying sticks 26. The base 22 of the pasta making accessory 20 is adapted for placement upon a support surface, such as a table or counter top. The base 22 preferably is in the form of a solid body having opposed flat planar top and bottom surfaces 22A, 22B and pairs of opposite side edges 22C extending between said top and bottom surfaces 22A, 22B. As seen in FIGS. 1, 4 and 5, the solid body of the base 22 can be provided in a rectangular configuration although other configurations are equally possible. Referring to FIG. 2, the base 22 further has a central recess 28 formed in the top surface 22A of the base 22. The central recess 28 extends partially downwardly from the top surface 22A thereof.

Referring to FIG. 2, the elongated hollow tubular post 24 of the pasta making accessory 20 has an elongated continuous cylindrical sidewall 30 extending between opposite top and bottom ends 24A, 24B of the tubular post 24 and having outside and inside surfaces 30A, 30B. The cylindrical sidewall 30 defines an interior storage cavity 32 with a diameter and height sufficient to store the elongated pasta drying sticks 26 therein. The tubular post 24 is supported at the bottom end 24B on the base 22 and extends upright therefrom. More specifically, the tubular post 24 is seated at the bottom end 24B within the recess 28 of the base 22.

Figure 3:
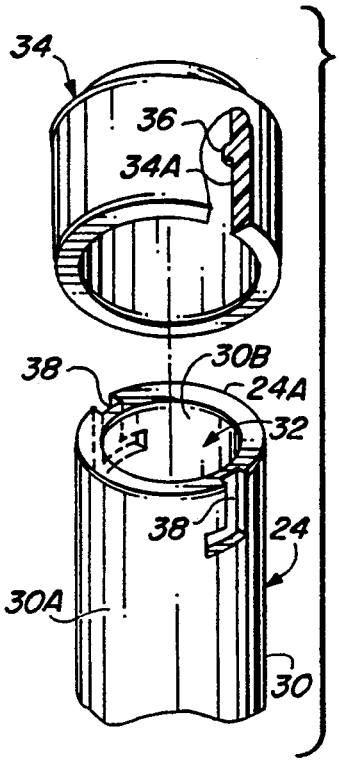
FIG. 3 is an enlarged exploded fragmentary view of the accessory of FIG. 1, showing interlocking features on an upper end of the tubular post and an end cap of the accessory.

Referring to FIGS. 1–3, the pasta making accessory 10 also includes cup-shaped end cap 34 fittable over the top open end 24A of the tubular post 24. The end cap 34 and the top end 24A of the tubular post 24 have complementary interlocking features thereon in the form of a pair of protuberances 36 on the interior surface 34A of the end cap 34 and a pair of L-shaped slots 38 formed in the top end 24A of the tubular post 24. These complementary releasable interlocking features will releasably fasten the top cap 34 over the top open end 24A of the tubular post 24 so as to enclose and retain the pasta drying sticks 26 therein.

Figure 6:
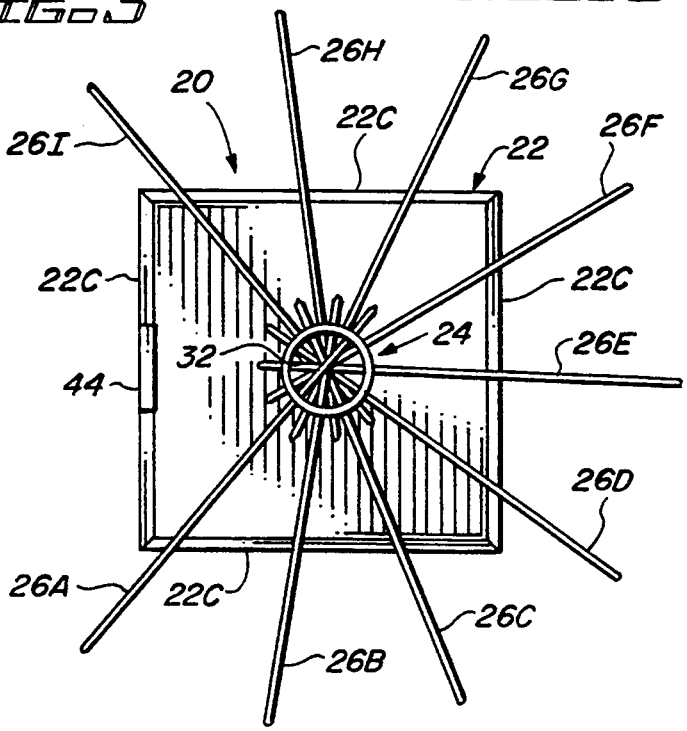
FIG. 6 is an enlarged top plan view of the accessory of FIG. 5 with the top end cap removed.
Figure 7:
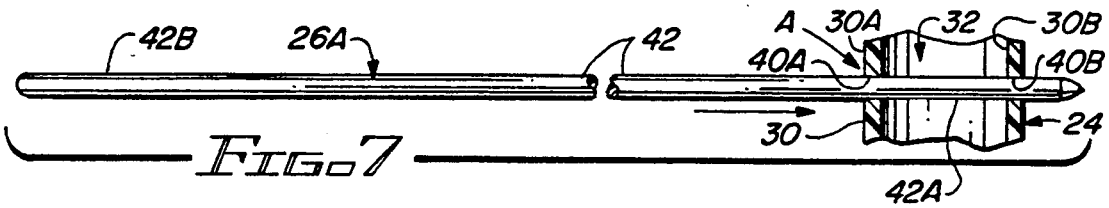
FIG. 7 is an enlarged fragmentary vertical sectional view of the tubular post and a foreshortened view of one of the pasta drying sticks mounted in the tubular post of the accessory.
Figure 8:
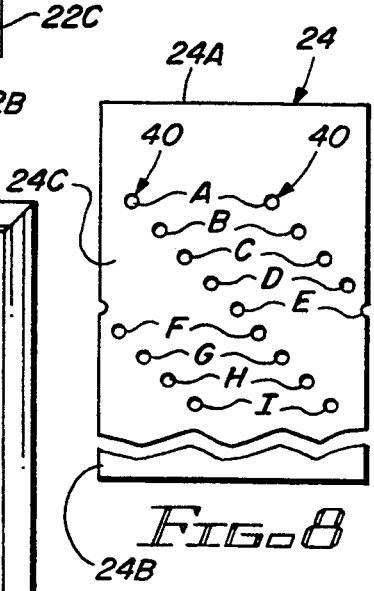
FIG. 8 is a layout plan view of an upper portion of the tubular post of the accessory illustrating the radial and helical pattern of the plurality of pairs of holes formed in the tubular post of the accessory in which the drying sticks are mounted.

Referring to FIGS. 1 and 5–8, the tubular post 24 has means defined thereon for removably mounting the plurality of pasta drying sticks 26 in an outward radially extending relationship circumferentially about the tubular post 24 so as to permit draping of pasta strips S thereover for drying. These means are a plurality of holes 40 defined about an upper portion 24C of the tubular post 24. As shown in the plan layout of the upper portion 24C of the tubular post 24 in FIG. 8, the holes 40 are provided in pairs A, B, C, D, E, F, G, H, I, being nine in number to match the nine pasta drying sticks 26. As seen in FIGS. 5 and 7, a given pair A of the holes 40 are defined at the same height above the base 22 but on opposite sides of the tubular post 24 diametrically across the interior storage cavity 32 of the tubular post 24 and thereby opposite from one another. Each hole 40 extends through the sidewall 30 of the tubular post 24 between the outside and inside surfaces 30A, 30B thereof. Also, each pair A–I of holes 40 is located at a height above the base different from the height of each other pair A–I of holes 40. Also, as can be clearly understood from FIG. 8, each pair A–I of holes 40 is located at an angular position about the tubular post 24 different from the position of each other pair A–I of holes 40. Thus, as can be seen in FIGS. 5, 6 and 8, the pairs A–I of holes 40 are arranged in a radial and helical pattern about the upper portion 24C of the tubular post 24.

Referring to FIGS. 2 and 4–7, the plurality of elongated pasta drying sticks 26 (which are identified in FIGS. 5 and 6 with prefixes A–I to match the pairs of holes A–I) of the pasta making accessory 10 are adapted to be removably placed and stored during non-use in a closely packed relationship with one another in the interior cavity 32 of the tubular post 24. Each drying stick 26A–26I is mounted through one pair of the pairs A–I of holes 40 in the tubular post 24. As seen in FIG. 7, each pasta drying stick 26 is in the form of an elongated rigid straight shaft 42 extending between a pair of opposite ends 42A, 42B. Each drying stick 26 is mountable at the one end 42A through the one pair of holes 40 in the tubular post 24 such that the one end 42A extends through the first hole 40A of the pair and also extends through and protrudes slightly beyond the second hole 40B of the pair. With the pairs A–I of holes 40 being so arranged and the plurality of drying sticks 26A–26I being so mounted in the pairs of holes, the drying sticks 26 thereby extend radially outwardly from the tubular post 24 and encircle the tubular post 24 in a helical path so as to provide sufficient space between the sticks 26 to facilitate draping of freshly extruded pasta strips S thereover for proper drying thereof.

Each pasta drying stick 26 also is of a sufficient length for permitting its use as a measurement instrument for cutting freshly-extruded pasta into individually-sized two-stick lengths. Such ensures that optimum length pasta is draped over the drying stick and is not in contact with the support surface when drying.

Disassembly of the pasta drying structure simply requires removal of the pasta drying sticks 26 from the pair of holes 40 in the tubular post 24. Each drying stick 26 is simply grasped by the fingers and pulled outwardly from the post 24 such that the on end 42A is withdrawn from the pair of opposed holes 40A, 40B. The sticks 26 are then cleaned and placed standing on end in the storage cavity 32 of the post 24. The end cap 34 is fitted over the top end 24A of the post 24 to retain the sticks 26 therein.

The pasta making accessory 20 can also serve dual functions or roles, the first being the pasta dryer as described above and the second being a paper towel holder dispenser. The tubular post 24 is adapted to removably receive a roll R of paper towels thereover with the roll R standing on the base 22 when the pasta drying sticks 26 have been removed from about the tubular post 24. The pasta making accessory 20 can also include a guide panel 44 mounted on the base 22 adjacent to but spaced from the tubular post 24 and extending upwardly therefrom for guiding the unwrapping of the roll R of paper towels when fitted over the tubular post 24.

The components of the pasta making accessory 20 can be made of any suitable material. A suitable material would be one that is resilient, readily available, and easy to clean, such as wood, plastic, metal or marble.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A pasta making accessory, comprising:

(a) a base for placement upon a support surface;

(b) an elongated hollow tubular post supported at a bottom end on said base and extending upright therefrom, said tubular post having an open top end and an interior storage cavity extending between said bottom and top ends; and (c) a plurality of elongated sticks adapted to be removably placed and stored during non-use in a closely packed relationship with one another in said elongated interior cavity of said tubular post;

(d) said tubular post having means defined thereon for removably mounting said plurality of sticks in an outward radially extending relationship about said post so as to permit draping of pasta strips thereover for drying;

(e) said tubular post having an elongated continuous sidewall extending between said opposite top and bottom ends and defining said interior storage cavity with a diameter to store said elongated pasta drying sticks therein.

2. The accessory of claim 1 further comprising:

a removable end cap fittable over said top open end of the tubular post.

3. The accessory of claim 1 wherein said tubular post is adapted to removably receive a roll of paper towels thereover and standing on said base when said sticks are removed from about said tubular post.

4. The accessory of claim 3 further comprising:

a guide panel mounted on said base adjacent to but spaced from said tubular post and extending upwardly therefrom for guiding the unwrapping of the roll of paper towels when fitted over said tubular post.

5. The accessory of claim 1 wherein said base is a solid body having opposed flat top and bottom surfaces and pairs of opposite side edges extending between said top and bottom surfaces.

6. The accessory of claim 5 wherein said base has a central recess formed in said top surface thereof, said tubular post being seated at said bottom end in said recess.

7. The accessory of claim 1 wherein said means for removably mounting said sticks on said tubular post is a plurality of pairs of holes defined about an upper portion of said post.

8. The accessory of claim 7 wherein said holes in a given pair are defined at the same height above said base, circumferentially spaced from one another about said tubular post, and disposed on opposite sides of said tubular post diametrically across said interior cavity of the tubular post from one another.

9. The accessory of claim 7 wherein each of said holes extends through a continuous sidewall wall of said tubular post between outer and inner surfaces thereof.

10. A pasta making accessory, comprising:

(a) a base for placement upon a support surface;

(b) an elongated hollow tubular post supported at a bottom end on said base and extending upright therefrom, said tubular post having an open top end and an interior storage cavity extending between said bottom and top ends; and (c) a plurality of elongated sticks adapted to be removably placed and stored during non-use in a closely packed relationship with one another in said elongated interior cavity of said tubular post;

(d) said tubular post having means defined thereon for removably mounting said plurality of sticks in an outward radially extending relationship about said post so as to permit draping of pasta strips thereover for drying;

(e) said means for removably mounting said sticks on said tubular post being a plurality of pairs of holes defined about an upper portion of said post, each pair of said holes being located at a height above said base different from the height of each other pair of said holes.

11. A pasta making accessory, comprising:

(a) a base for placement upon a support surface;

(b) an elongated hollow tubular post supported at a bottom end on said base and extending upright therefrom, said tubular post having an open top end and an interior storage cavity extending between said bottom and top ends; and (c) a plurality of elongated sticks adapted to be removably placed and stored during non-use in a closely packed relationship with one another in said elongated interior cavity of said tubular post;

(d) said tubular post having means defined thereon for removably mounting said plurality of sticks in an outward radially extending relationship about said post so as to permit draping of pasta strips thereover for drying;

(e) said means for removably mounting said sticks on said tubular post being a plurality of pairs of holes defined about an upper portion of said post, each pair of said holes being located at an angular position about said tubular post different from the position of each other pair of said holes.

12. A pasta making accessory, comprising:

(a) a base for placement upon a support surface;

(b) an elongated hollow tubular post supported at a bottom end on said base and extending upright therefrom, said tubular post having an open top end and an interior storage cavity extending between said bottom and top ends; and (c) a plurality of elongated sticks adapted to be removably placed and stored during non-use in a closely packed relationship with one another in said elongated interior cavity of said tubular post;

(d) said tubular post having means defined thereon for removably mounting said plurality of sticks in an outward radially extending relationship about said post so as to permit draping of pasta strips thereover for drying;

(e) said means for removably mounting said sticks on said tubular post being a plurality of pairs of holes upper portion of said post, said pairs of holes being arranged in a radial and helical pattern about said upper portion of said tubular post.

13. A pasta making accessory, comprising:

(a) a base for placement upon a support surface;

(b) an elongated hollow tubular post supported at a bottom end on said base and extending upright therefrom, said tubular post having an open top end and an interior storage cavity extending between said bottom and top ends; and (c) a plurality of elongated pasta drying sticks adapted to be removably placed and stored during non-use in a closely packed relationship with one another in said elongated interior cavity of said tubular post, each of said pasta drying sticks being an elongated straight shaft extending between a pair of opposite ends;

(d) said tubular post having means defined thereon for removably mounting said plurality of sticks in an outward radially extending relationship about said post so as to permit draping of pasta strips thereover for drying;

(e) said means for removably mounting said sticks on said tubular post being a plurality of pairs of holes defined about an upper portion of said post, said holes in a given pair being defined at the same height above said base, circumferentially spaced from one another about said tubular post, and disposed on opposite sides of said tubular post diametrically across said interior cavity of the tubular post from one another.

14. The accessory of claim 13 wherein each of said pasta drying sticks is mounted through one pair of said plurality of pairs of holes in said tubular post.

15. The accessory of claim 14 wherein each drying stick is mountable at one end through one of said holes of a given pair defined in said tubular post such that said one end extends through a first hole of said pair and extends through and protrudes slightly beyond a second hole of said pair.

16. A pasta making accessory, comprising:

(a) a base for placement upon a support surface;

(b) an elongated hollow tubular post supported at a bottom end on said base and extending upright therefrom, said tubular post having an open top end and an interior storage cavity extending between said bottom and top ends; and (c) a plurality of elongated sticks adapted to be removably placed and stored during non-use in a closely packed relationship with one another in said elongated interior cavity of said tubular post;

(d) said tubular post having means defined thereon for removably mounting said plurality of sticks in an outward radially extending relationship about said post so as to permit draping of pasta strips thereover for drying;

(e) said drying sticks, when extending radially outwardly from said tubular post, encircling said post in a helical path so as to provide sufficient space between the sticks to facilitate draping of freshly extruded pasta strips thereover for proper drying thereof.

17. A pasta making accessory, comprising:

(a) a base for placement upon a support surface;

(b) an elongated hollow tubular post supported at a bottom end on said base and extending upright therefrom to an open top end, said tubular post being in the form of an elongated continuous tubular sidewall extending between said opposite top and bottom ends and defining an interior storage cavity;

(c) an end cap removably fittable over said top open end of the tubular post; and (d) a plurality of elongated pasta drying sticks adapted to be removably placed and stored during non-use in a closely packed relationship with one another in said interior storage cavity of said tubular post, said storage cavity having a diameter and a height sufficient to store said pasta drying sticks therein;

(e) said tubular post having means defined thereon for removably mounting said plurality of pasta drying sticks in an outward radially extending relationship about said tubular post so as to permit draping of pasta strips thereover for drying, said means for removably mounting said sticks being a plurality of pairs of holes defined through said sidewall of said tubular post about an upper portion of said tubular post, said holes in a given pair being defined at the same height above said base circumferentially spaced from one another about said tubular post and disposed on opposite sides of said tubular post diametrically across said interior cavity of the tubular post from one another, each pair of said holes being defined a height above said base being different from each other pair of said holes, each pair of said holes being defined at an angular position about said tubular post being different from the position of each other pair of said holes such that said pasta drying sticks are extendable radially outwardly from said tubular post and encircle said tubular post in a helical path so as to provide sufficient space between the pasta drying sticks to facilitate draping of freshly extruded pasta strips thereover for proper drying thereof.

18. The accessory of claim 17 wherein each of said pasta drying sticks is an elongated straight shaft extending between a pair of opposite ends.

19. The accessory of claim 17 wherein each of said pasta drying sticks is mounted through one pair of said plurality of pairs of holes in said tubular post, each drying stick is mountable at one end through one of said holes of a given pair defined in said tubular post such that said one end extends through a first hole of said pair and extends through and protrudes slightly beyond a second hole of said pair.

* * * * *